United States Patent [19]

Kim et al.

[11] 4,076,247

[45] Feb. 28, 1978

[54] MOVING TARGET ASSEMBLY AND CONTROL

[75] Inventors: Raymond W. H. Kim, Skokie; Erwin E. Figge, Des Plaines, both of Ill.

[73] Assignee: Bell & Howell Company, Chicago, Ill.

[21] Appl. No.: 684,044

[22] Filed: May 7, 1976

[51] Int. Cl.[2] ..... F41J 9/00

[52] U.S. Cl. ..... 273/105.6

[58] Field of Search ..... 40/32; 46/216; 74/436; 104/147 A; 273/101.1, 101.2, 102 R, 102 S, 102.1 E, 105.2, 105.6, 127 D; 35/25

[56] References Cited

U.S. PATENT DOCUMENTS

| | | | |
|---|---|---|---|
| 2,457,832 | 1/1949 | Poorman | 35/25 X |
| 3,034,788 | 5/1962 | Cauble | 273/105.6 |
| 3,348,843 | 10/1967 | Stanley | 273/105.6 |
| 3,775,897 | 12/1973 | Soulakis | 46/216 X |
| 3,865,373 | 2/1975 | Knight | 273/105.6 X |
| 3,964,701 | 6/1976 | Kacerek | 104/147 A |

FOREIGN PATENT DOCUMENTS

| | | | |
|---|---|---|---|
| 1,113,883 | 9/1961 | Germany | 273/105.6 |
| 1,801,552 | 2/1970 | Germany | 273/105.6 |

*Primary Examiner*—Richard T. Stouffer
*Assistant Examiner*—Vance Y. Hum
*Attorney, Agent, or Firm*—Richard Gray; John Moore; Roger M. Fitz-Gerald

[57] ABSTRACT

The disclosure relates to a moving target assembly for use in a target practice range. The moving target assembly includes a target, a target travel guide for guiding the target movement and including a pair of straight sections which are substantially at right angles to one another, and a chain drive running substantially parallel to the straight sections.

17 Claims, 11 Drawing Figures

MOVING TARGET ASSEMBLY AND CONTROL

BACKGROUND OF THE INVENTION

The present invention is directed to a moving target assembly and control means therefore and in particular to a moving target assembly and control means therefore for use in a target practice range of the type having a plurality of firing lanes wherein each lane has a plurality of ranges.

Moving target assemblies for use in target practice ranges have taken many forms. One very popular form has a moving target sweep across the marksman's field. Such targets may be carried on continuous belts or the like. Such assemblies do not afford a realistic representation of the conditions faced by a marksman when he applies his skills to actual use. In actual practice, targets will either approach toward or retreat from a marksman at an angle and additionally, the marksman will have no forewarning as to which direction a target will move. Moving target assemblies heretofore have not provided a realistic representation of a real life situation faced by a marksman when he applies his learned skills to practice.

It is therefore a general object of the present invention to provide a new and improved moving target assembly for use in a target practice range.

It is a more particular object of the present invention to provide a moving target assembly for use in a target practice range wherein the direction of target travel is selective to either the left or the right of a marksman and towards the marksman at an angle.

It is a still more particular object of the present invention to provide a moving target assembly for use in a target practice range which includes means for returning the moving target to a home position at the end of each practice run.

It is a still more particular object of the present invention to provide a target range comprising a plurality of firing lanes, wherein each of the firing lanes includes a plurality of ranges, and wherein the target range includes control means for selecting all of the moving targets corresponding to a given range.

It is a still more particular object of the present invention to provide a new and improved target range of the type which includes a plurality of firing ranges, and wherein the target range includes control means for selectively raising or lowering all of the moving targets corresponding to a given range.

It is a still another more particular object of the present invention to provide a target range of the type which includes a plurality of firing lanes, wherein the lanes include an equal number of ranges, and wherein a moving target is provided for each lane and range, means for causing selected ones of the targets to move at different speeds.

SUMMARY OF THE INVENTION

The invention provides a moving target assembly for use in a target practice range comprising a target travel guide having first and second straight sections, the first and second straight sections being joined and being substantially at right angles to one another and each including a free end, and a third section connected to the common junction of the first and second sections, a common junction constituting a home position, target means including a carriage base adapted for traveling within the travel guide, a target member on the carriage base, and first and second chain engaging means, the first and second chain engaging means being selectively operable, and chain drive means running substantially parallel to the first, second, and third sections, and being arranged for cooperative engagement with the first and second chain engaging means for driving the target means from the home position along the first straight section when the first chain engaging means is selectively operated, and for driving the target means from the home position along the second straight section when the second chain engaging means is selectively operated.

The invention also provides a target range of the type which includes a plurality of firing lanes wherein the lanes include an equal number of ranges. The target range comprises a moving target assembly for each range within each lane, each moving target assembly including a target means including a carriage base, a travel guide for accepting the carriage base and guiding the target means from a home position, through a predetermined path, and back to the home position, and drive motor means for driving the target means along the travel guide, a power supply for supplying energizing power for each drive motor, and control means for selectively connecting the power supply to each drive motor of a given range.

BRIEF DESCRIPTION OF THE DRAWINGS

The features of the present invention which are believed to be novel are set forth with particularity in the appended claims. The invention, together with further objects and advantages thereof, may best be understood by reference to the following description taken in conjunction with the accompanying drawings, in the several figures in which like reference numerals identify like elements, and in which:

DESCRIPTION OF THE PREFERRED EMBODIMENT

Figure 1:
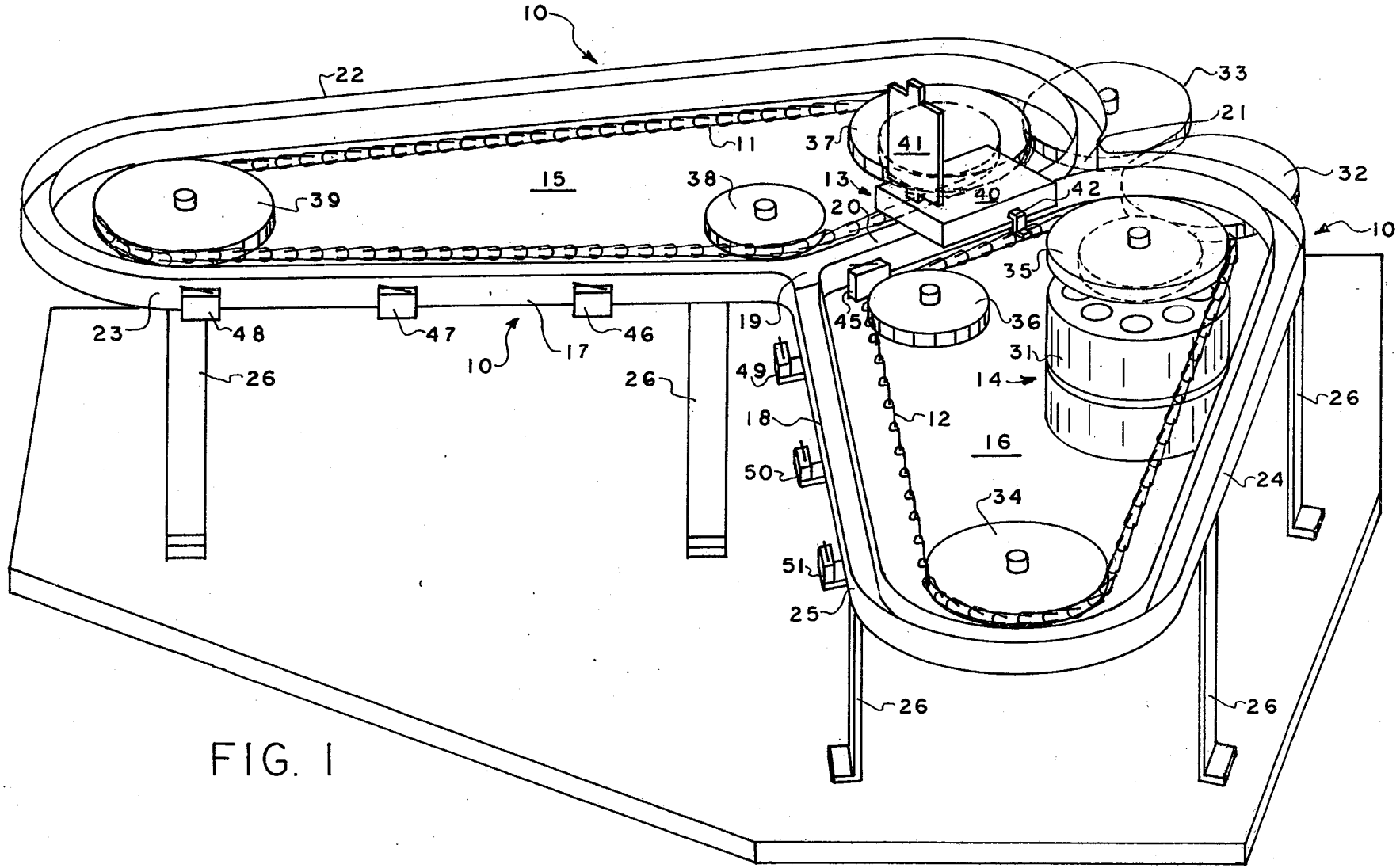
FIG. 1 is a perspective view showing one embodiment of a moving target assembly in accordance with the present invention.

Referring now to FIG. 1, the moving target assembly thereshown generally includes a target travel guide 10, first chain means 11, second chain means 12, a target assembly or target means 13, and chain drive means 14. One type of target assembly usable with the present invention is the subject of co-pending U.S. Pat. No. 4,032,146 assigned to the owner of this patent.

Target travel guide 10 has a generally U-shaped cross section having a first mirror image half section 15, and a second mirror half section 16. Each of the mirror image half sections includes a straight section, the first mirror half section 15 having first straight section 17 and the second mirror image half section 16 having second straight section 18. First straight section 17 and second straight section 18 are joined at a common junction 19 which constitutes a home position. The target travel guide also includes a common side or a third straight section 20 which has a first end coupled to the common junction or home position 19 and a second end 21.

The first mirror image half section 15 also includes a first return portion 22 connecting the free end 23 of first straight section 17 to the second end 21 of the common side 20. In a like manner, second mirror image half section 16 includes a second return portion 24 which connects free end 25 of straight section 18 to the second end 21 of the common side 20.

The target travel guide 10 includes support legs 26 for supporting the target travel guide above a horizontal base surface 30.

The first chain means 11 and second chain means 12 constitute a chain drive which runs substantially parallel to the first straight section, second straight section, third straight section, and the return portions of the target travel guide with the first chain means 11 being associated with the first half section 15 and the second chain means 12 being associated with the second half section 16. The first and second chain means may comprise sprocket chains of the type well known in the art and therefore such sprocket chains need not be described in detail herein.

The drive means for driving the first and second chains 11 and 12 includes a motor 31, idler gears 32 and 33, and sprocket gears 34, 35, 36, 37, 38 and 39. Gears 37, 38 and 39 are arranged so that the first chain 11 runs substantially parallel to the target travel guide first half section 15. In a similar manner, gears 34, 35 and 36 are arranged so that chain 12 runs substantially parallel to the target travel guide second half section 16.

The target assembly 13 includes a carriage base 40 which is adapted for traveling within the travel guide and a target forming member 41 which is mounted on the carriage base 40 in a pivotal manner so that target member 41 may be raised or lowered in a manner to be described hereinater. The carriage base 40 includes first and second chain engaging means which are solenoid actuated. One such chain engaging means is shown at 42. In a preferred form, each chain engaging means is associated with its own solenoid and is selectively operable.

Each of the chain engaging pins is adapted for engaging its associated sprocket chain when selectively operated. To this end, for example, when pin 42 is to be engaged, its associated solenoid is selectively operated causing it to extend through carriage base 40 into engagement relation with the sprocket chain 12. Motor 31 turns sprocket gear 35 in a counter-clockwise direction to drive the second chain 12 in a direction running from the home position 19 towards free end 25 of the second section 18. Because idler gears 32 and 33 couple gear 35 to gear 37, gear 37 will turn in a clockwise direction which causes chain 11 to be driven in a direction from home position towards second end 23 of the first straight section 17. Therefore, when motor 31 is running, and the second pin 42 is caused to engage the sprocket chain 12, target assembly 13 will be caused to travel down the second straight section 18. In a similar manner, when the sprocket engaging pin on the other side of carriage base 40 engages sprocket chain 11, the target assembly 13 will be caused to travel down the first straight section 17.

In its preferred form, the moving target assembly is arranged relative to the target marksman so that each of the first and second straight sections are equadistant from the target marksman. In other words, when target member 13 moves down the first straight section 17, it will be moving to the left of the marksman at a 45° angle and when the target 13 moves down the second straight section 18, it will be moving to the right of the marksman at a 45° angle.

Return sections 22 and 24 constitute means for returning the target assembly 13 to home position 19. In order to stop the target 13 at home position, the moving target assembly of FIG. 1 additionally includes a switch means constituting microswitch 45 at home position 19. Microswitch 45 has a normally closed contact which is coupled to motor 31 for providing the motor with energizing power. Microswitch 45 is also arranged relative to the third straight section 20 such that the normally closed contact will open when actuated by carriage base 40 as it passes by the microswitch. When the target 13 returns to home position, it will therefore engage the microswitch 45 for opening the normally closed contact, and terminating the application of the energizing power to the motor 31. Hence, motor 31 is caused to stop and thus, target 13 will come to rest at home position. Microswitch 45 additionally includes a second normally closed contact which will momentarily open when actuated by the target for disengaging the solenold associated with the engaged chain engaging pin for resetting the chain engaging pins to a non-engaging condition to ready the target 13 for its next practice run.

As will be described in more detail hereinafter, target assembly 13 includes target member drive means within carriage base 40 for selectively raising or lowering target member 41. Such target member drive means may be actuated for lowering the target member 41 when anyone of a number of conditions are present. The target member 41 may be lowered when a marksman has hit the target, when the target has traversed a predetermined distance along one of the straight sections without being hit, or when an instructor wishes to manually lower the target. For lowering the target member 41 after it has traversed a predetermined distance along one of the straight sections, first straight section 17 includes a first set of trip switches including trip switches 46, 47 and 48. In a similar manner, the second straight section 18 includes a second set of trip switches comprising trip switches 49, 50 and 51. Each of the trip switches is arranged relative to the travel guide so that it is actuated when the target 13 passes by. In particular, each of the trip switches includes a normally open contact which is closed when the target member passes for completing an electrical path from a power source to a motor within carriage base 40 which forms a part of the target member drive means for lowering target member 41.

Each of the microswitches 46, 47 and 48 are equally spaced. In a similar manner, microswitches 49, 50 and 51 are equally spaced. In its preferred form, trip switch 46 and trip switch 49 are 5 meters from home position 19, trip switch 47 and trip switch 50 are 7.5 meters from home position, and trip switch 48 and trip switch 51 are 10 meters from home position. Each of the trip switches are selectively operable in a manner to be described hereinafter in relation to FIG. 9. Suffice it to say here that should trip switch 46 be selected, when the carriage base 40 of target assembly 13 arrives at microswitch 46, microswitch 46 will close causing an energizing voltage to be applied to the motor within carriage base 40 for lowering target member 41. The necessary power for the motor may be provided by a rail running along the travel guide but electrically insulated from the guide. With power applied to the rail, the power may be transferred to carriage 40 by providing it with brush wipers contacting the rail. Such structures are well known.

Figure 2:
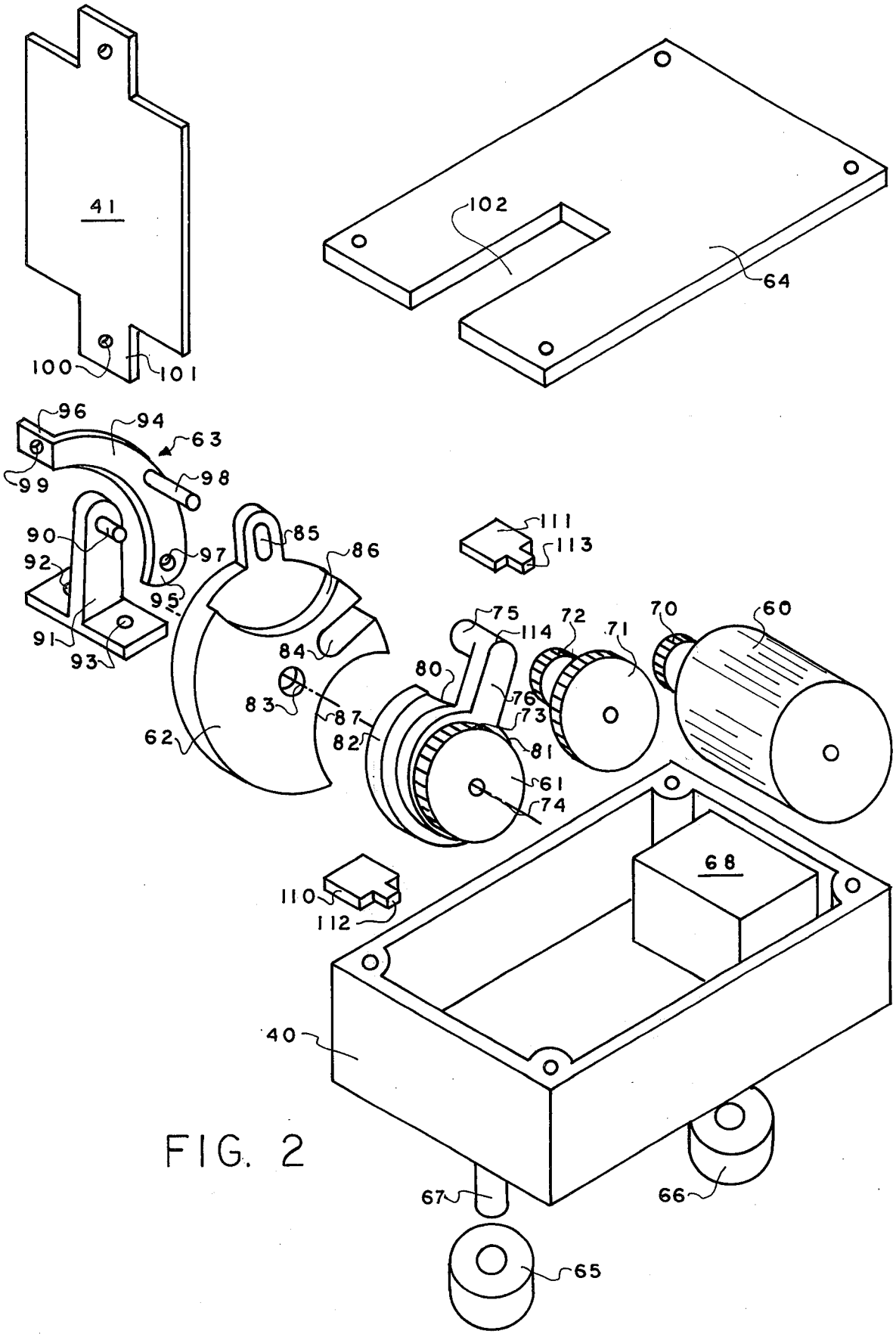
FIG. 2 is an exploded perspective view showing a target assembly which may be utilized in practicing the present invention.

Referring now to FIG. 2, it shows an exploded view of a target assembly which may be utilized in practicing the present invention in cooperation with the target travel guide shown in FIG. 1. The target assembly of FIG. 2 comprises carriage base 40, a motor 60, a first rotatable member 61, a second rotatable member 62, a coupling means 63, a top cover 64, and a target forming member 41.

Carriage base 40 includes a pair of horizontally disposed rollers 65 and 66 which are mounted for rotation on downwardly extending rods, one of which is shown at 67. Rollers 65 and 66 have a suitable diameter for being received into the generally U-shaped cross-section channel guide of FIG. 1. Carriage base 40 also has enclosure 68 which may contain control circuitry such as the previously referred to chain engaging solenoid.

Motor 60 includes a driven shaft terminating in gear 70 and is adapted for being mounted within carriage base 40. Motor 60 is of the type which is capable of driving the driven shaft and gear 70 in first and second angular directions.

The motor 60 is coupled to the first rotatable member 61 by coupling gears 71 and 72 which are fixed relative to one another. Gear 71 engages gear 70 and gear 72 engages a gear surface 73 carried by first rotatable member 61.

The first rotatable member includes a first axis of rotation 74 and an extension 75 which extends parallel to the first axis 74 and which is radially spaced from the first axis 74 by arm 76. Extension 75 is displaceable between a second position as shown in FIG. 2 and a first position wherein the extension is displaced 180° from its position shown in FIG. 2 with rotation of first rotatable member 61.

For reasons to be more fully explained hereinafter, first rotatable member 61 also includes a concave peripheral cam surface 80 and first and second convex cam surfaces 81 and 82 respectively. Convex cam surface 81 is on one side of the concave cam surface 80 and convex cam surface 82 is on the other side on concave cam surface 80.

The second rotatable member 62 includes a second axis of rotation 83 and also includes a generally radial slot 84 which extends from the periphery of second rotatable member 62 towards the second axis of rotation 83. The generally radial slot 84 is dimensioned for receiving extension 75 and the first and second rotatable members are arranged relative to one another for aligning slot 84 with extension 75 so that extension 75 may be captured by slot 84 with rotation of first rotatable member 61.

Second rotatable member 62 also includes a second slot 85 at its periphery which is also radially extending in relation to the second axis of rotation 83. Slot 85 is off-set so that as the first and second members rotate relative to one another, extension 75 will not come into contact with the second slot 85.

Coupling means 63 couples the target forming member 41 to the second rotatable member 62 so that as the second rotatable member 62 rotates, the target forming member 41 will be lowered and raised between a vertical position as shown and a horizontal position. The coupling means 63 includes pivot arm 90 which is intrically formed on a base 91. Base 91 has holes 92 and 93 for mounting within carriage base 40. The coupling means also includes an arcuate arm 94 having a first end 95 and a second end 96 which constitutes a flanged position from arcuate arm 94. First end 95 has an opening 97 which captures pivot arm 90 so that arcuate arm 94 may be pivotably rotated about pivot arm 90. Arcuate arm 94 also includes a pin 98 extending towards the second rotatable member and which is received by the second slot 85. Second end 96 includes an opening 99 which may be aligned with opening 100 of target member 41 for securing the target member 41 to the second end 96 of arcuate arm 94 with suitable securing means well known in the art.

Target member 41 includes an extension 101 of relatively narrow dimension. Top cover 64 includes rectangular slot 102 which is dimensioned for receiving the extension 101 of target member 41. Thus, target member 41 extends above top cover 64 through rectangular slot 102. Rectangular slot 102 is relatively long for allowing target member 41 to travel in an arc between the vertical position as shown and a horizontal position.

For controlling the lowering and raising operation of motor 60, the target assembly also includes a first microswitch 110 and a second microswitch 111. The first and second microswitches 110 and 111 respectively each includes a normally closed contact coupled to contact arms 112 and 113 respectively. Contact arms 112 and 113 are arranged relative to the end 114 of arm 76 so that when extension 75 is in the second position as shown, end 114 is in contact with arm 113, for opening microswitch 111. In a similar manner, when extension 75 is in the first position, 180° from the position shown, end 114 of arm 76 is in contact with contact arm 112 for opening microswitch 110.

The microswitches are coupled to an appropriate power supply and to motor 60. Microswitch 111 is coupled to a first polarity energizing voltage and to motor 60 for applying the first polarity energizing voltage to motor 60 in order to raise target member 41. In a similar manner, microswitch 110 is coupled to a source of second polarity energizing voltage and to motor 60 to cause the motor to turn in an opposite direction for lowering the target member. Control means to be described hereinafter switches the first microswitch 110 into the control circuit when the target is to be lowered, and switches the second microswitch 111 into the control circuit when the target is to be raised.

Second rotatable member 62 includes a first concave cam surface 86 on the other side of slot 84. The first and second rotatable members are arranged relative to one another so that when extension 75 is in the second position as shown, the second concave cam surface 87 and the second convex cam surface 82 are mating to therefore preclude rotatable member 62 from rotating and to thus lock the target member 41 in a vertical position. When target member 41 is lowered, the first convex cam surface 81 and the first concave cam surface 86 are mated together for locking the target member 41 in the horizontal or lowered position. The concave cam surfaces 87, 86 and 80 co-act to free the first and second rotatable members for rotation between the first and second positions. This arrangement is commonly referred to as a geneva wheel mechanism.

Figure 3:
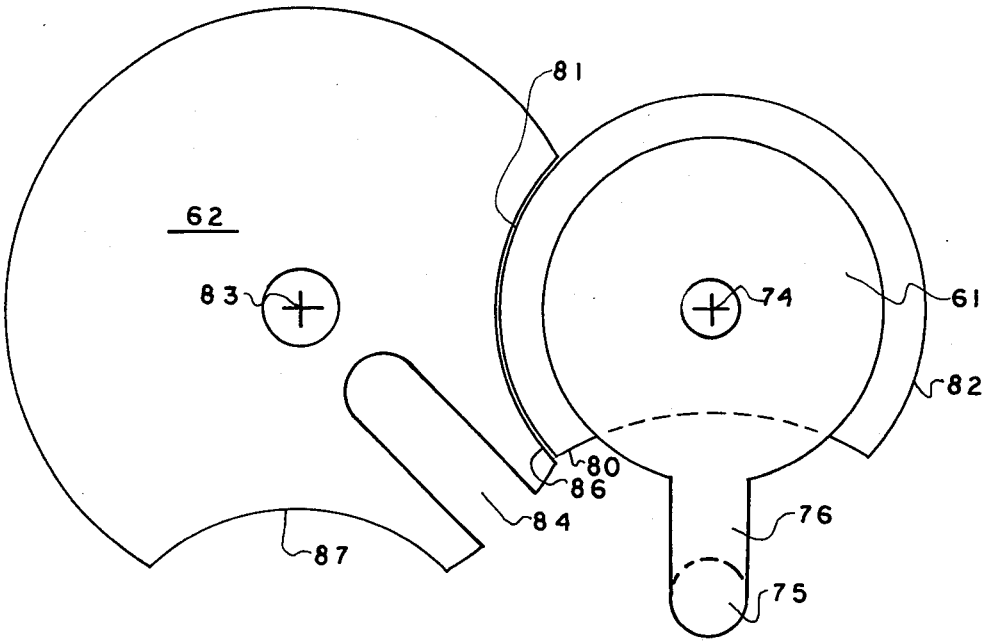
FIGS. 3 through 7 are plan views showing the operation of the target assembly of FIG. 2.
Figure 5:
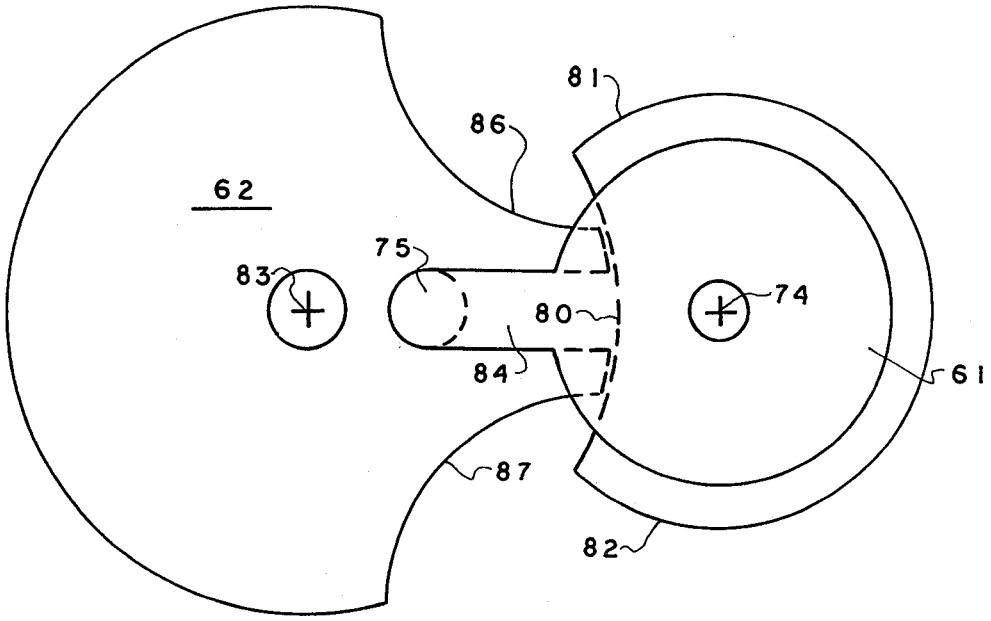
Figure 6:
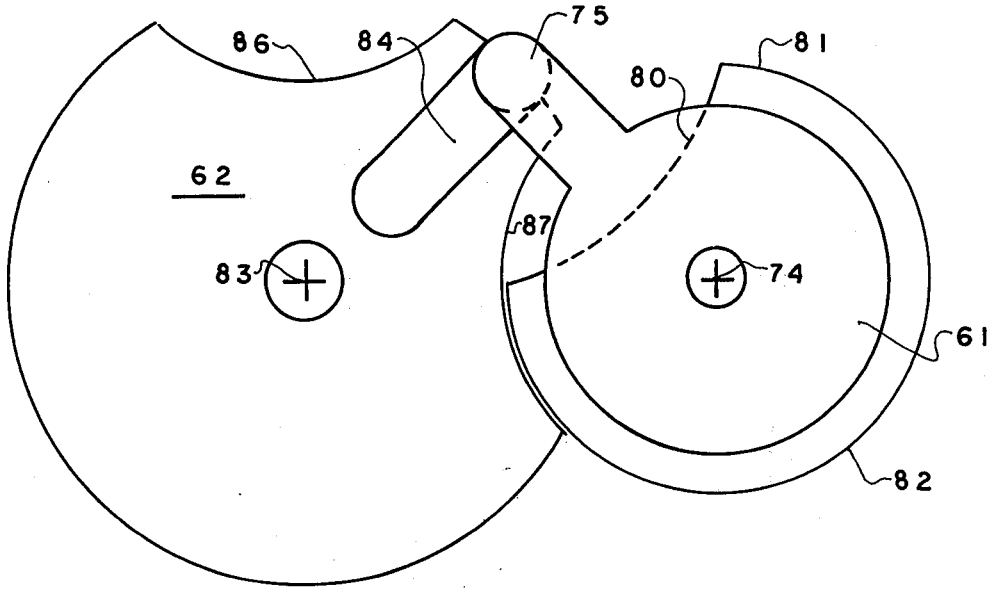
Figure 7:
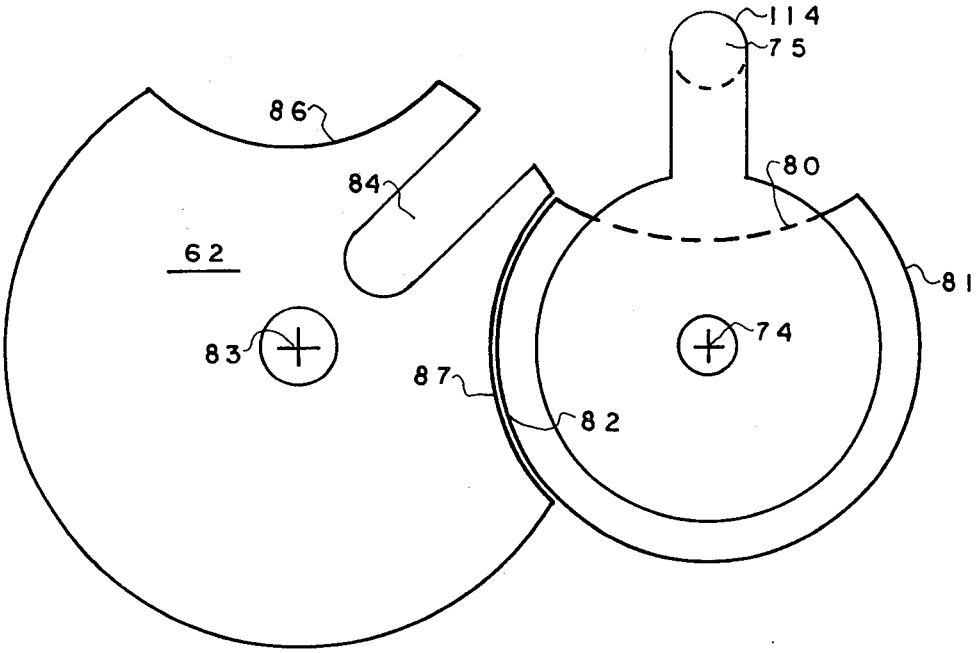

FIGS. 3 through 7 show the relative rotational positions of the first and second rotatable members as extension 75 is rotated between its first position as shown in FIG. 3 and its second position as shown in FIG. 7. As shown in FIG. 3, extension 75 is in its first position with the first concave cam surface 86 and the first convex cam surface 81 mating. With extension 75 in this first position, the target member 41 is in its fully lowered position.

Figure 4:
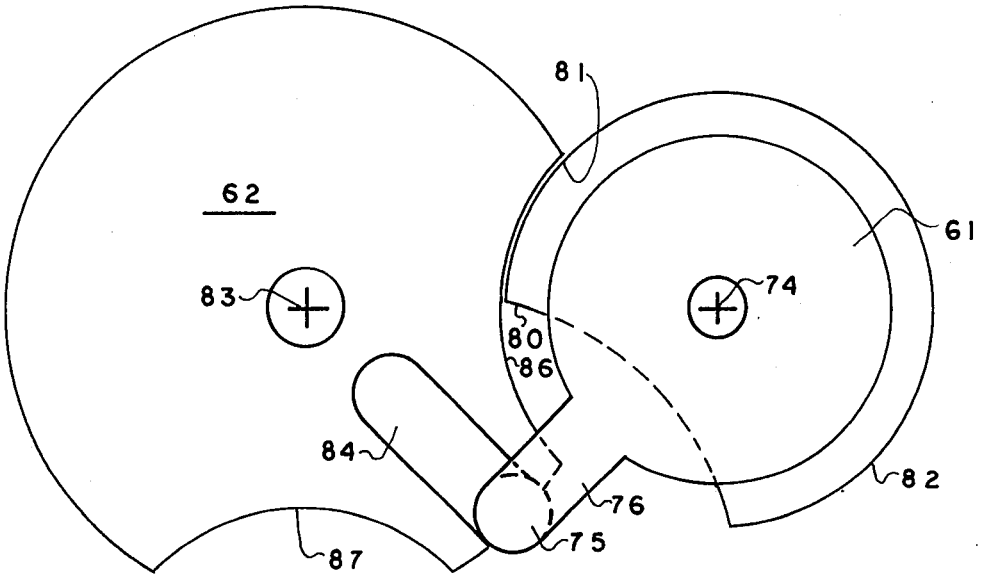

As shown in FIG. 4, as extension 75 moves clockwise, it is captured within slot 84. In its position shown in FIG. 4, extension 75 has moved 45° in a clockwise direction from its first position as shown in FIG. 3. Second reotatable member 62 has not yet rotated but is now free to rotate because concave cam surface 80 is at substantially right angles to concave cam surface 86. As the first rotatable member 61 and the extension 75 continue to rotate in a clockwise direction, the second rotatable member 62 will not rotate in a counter-clockwise direction to raise the target member 41 of FIG. 1.

FIG. 5 shows the first and second rotatable members after extension 75 has rotated 90° in a clockwise direction from its first position as shown in FIG. 1. The target member 41 is now in its half raised position. As the first rotatable member 61 continues to rotate in a clockwise direction, the target member 41 continues to be raised with the counter clockwise rotation of second rotatable member 62.

FIG. 6 shows the extension 75 as it is about to leave slot 84. In this position, extension 75 has rotated 135° in a clockwise direction from its original first position as shown in FIG. 3. The target member 41 is now fully raised.

The extension 75 will still continue to rotate about axis 74 until it is in the second position which is 180° displaced from its first position. The second rotatable member will no longer rotate because the extension 75 is no longer captured within slot 84.

When extension 74 reaches its second position as shown in FIG. 7, the second concave cam surface 87 and the second canvex cam surface 82 are mated to thereby prevent the second rotatable member 62 from further rotation and to thereby lock the target member in the vertical position as shown in FIG. 2.

With extension 75 now in its second position, end 114 will contact the second microswitch 111 and its arm 113 to thereby open microswitch 111 and to terminate the application of the first polarity voltage to motor 60 to turn motor 60 off. As will be more fully described subsequently, the second microswitch 111 also includes a norally open contact which closes when arm 113 is contacted by end 114 of arm 76 to cause the selected one of the solenoid within carriage base 40 to be energized so that the selected chain engaging means is caused to engage the proper chain to cause the target to move to the left or the right of the marksman. Thus, a chain is engaged a predetermined time after the target has been fully raised. In its preferred embodiment, this predetermined time is one second.

When the target is to be lowered, the target is lowered in a manner which is just the reverse of the procedure just explained. When extension 75 returns to its first position, the first microswitch 110 will be caused to open to thereby terminate the application of the second polarity voltage to motor 60.

Figure 10:
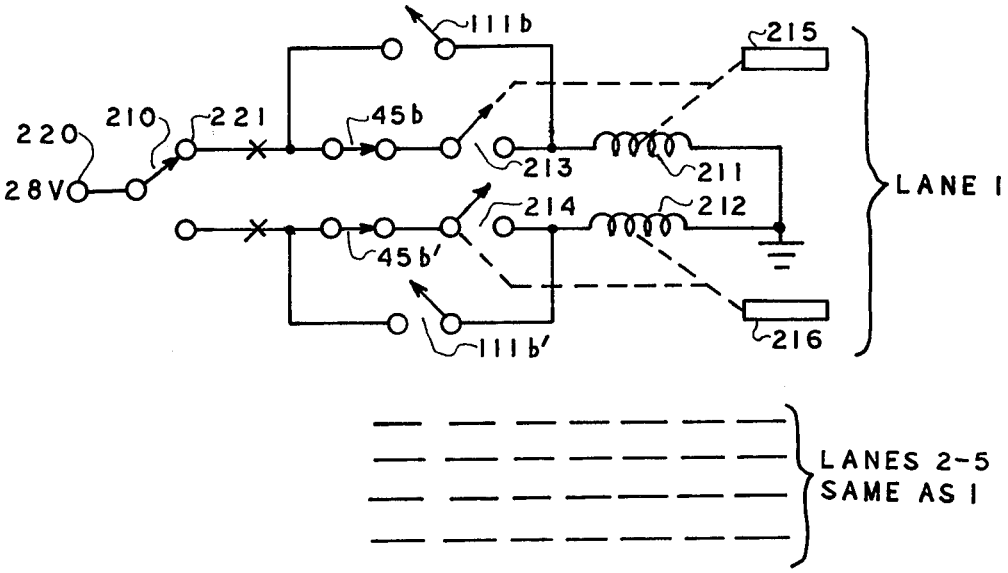
FIG. 10 is a schematic circuit diagram of a control circuit embodying the present invention.
Figure 8:
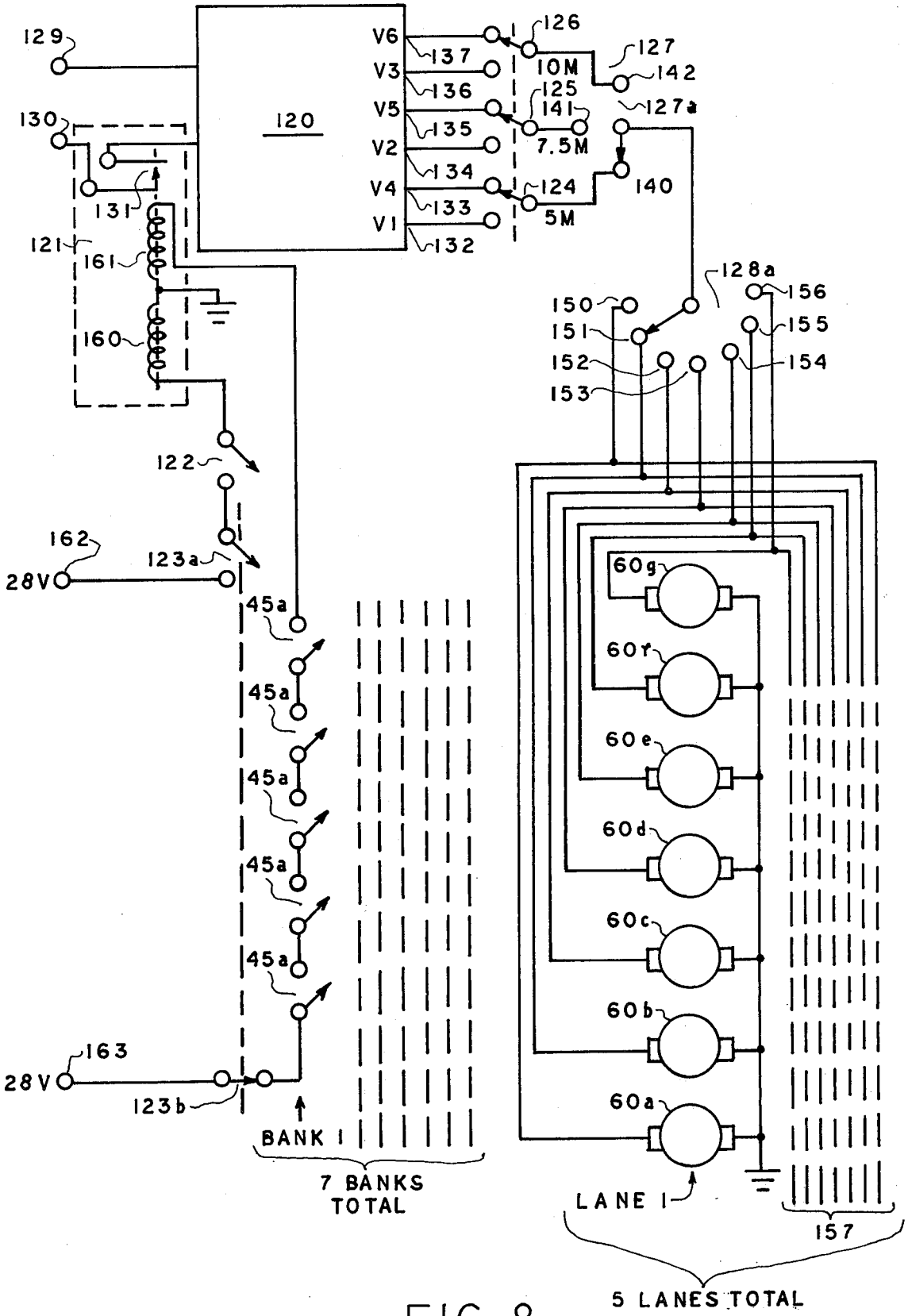
FIG. 8 is a schematic circuit diagram of a control circuit embodying the present invention.
Figure 9:
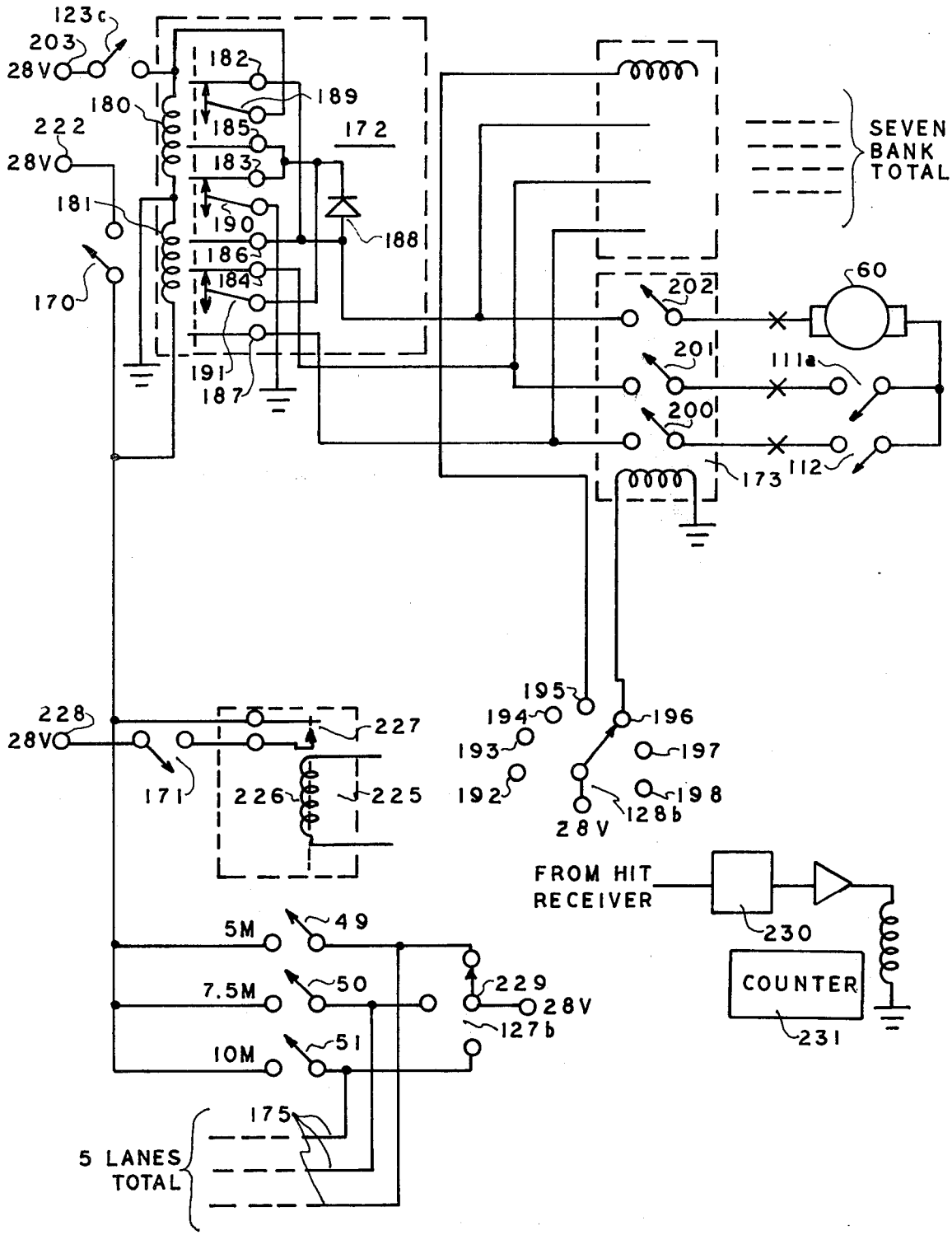
FIG. 9 is a schematic circuit diagram with a control circuit embodying the present invention.

FIGS. 8 through 10 show schematic circuit diagrams of control circuits which may be utilized for controlling the moving target assembly of FIG. 1. In addition, the circuits of FIGS. 8 through 10 may also by used in a target practice range which has a plurality of firing lanes, each lane having an equal number of ranges. In such target practice range a moving target assembly such as that shown in FIG. 1 is provided for each lane and each range. For example, if there are to be five firing lanes and seven ranges, there would be a total of 35 moving target assemblies to be controlled.

Referring now to FIG. 8, FIG. 8 shows the control circuitry for controlling each chain drive motor 60 (FIG. 1) of each moving target assembly for each lane and range. The control circuit of FIG. 8 includes a power supply 120, a latching relay 121, control switches 122, 123, 124, 125, 126, 127 and 128. Also shown in FIG. 8 are the first normally closed contacts **45*a* of each home position switch 45 for each moving target assembly as shown in FIG. 1 and the chain drive motors 60*a* through 60*g*** for each range within the first firing lane.

The power supply 120 has an input terminal 129 and latching relay 121 has an input terminal 130 adapted for connection to an AC voltage source so that the AC voltage source is applied to power supply 120 when latching relay contact 131 is closed. Power supply 120 has a plurality of outputs 132 through 137 for supplying a plurality of different chain drive motor energizing voltages in response to the applied AC voltage source at input terminals 129 and 130.

Switches 124, 125 and 126 are ganged together and are utilized for selecting different speeds of travel for the moving target members. Switch 127 has a first section **127*a* for selecting a given speed. Section 127*a* includes contacts 140, 141 and 142. Recalling for a moment that the first and second straight sections of the moving target assembly of FIG. 1 each includes three microswitches which are equally spaced, and that power supply 120 has six outputs, for each of the three distances running from home position to the respective trip switches, a speed may be selected so that the target will traverse each of the three distances in first or second predetermined time periods. For example, if the first trip switch 46 (FIG. 1) is to be selectively operated, switch 127*a* will be in the position shown in FIG. 8 such that contact 140 will be selected. Switch 124 can now be used for selecting either power supply output 132 or 133 to provide the chain drive motors with energizing power such that the target will travel from home position to the first trip switch in either the first or second predetermined time periods. For example, output 132 may provide a first voltage for causing the chain drive motor to drive the target from home position to the first microswitch in four seconds, and output 133 may provide a second energizing voltage which causes the chain drive motor to drive the target from the home position to the first microswitch in two seconds. In a similar manner, contact 141 may be utilized in conjunction with switch 125 and outputs 134, 135 to cause the target to travel from home position to the second trip switch in two or four second time intervals and contact 142 along with switch 126 and outputs 136 and 137** may be utilized for causing the target to be driven from home position to the last trip switch in a time period of two or four seconds.

As can be seen in FIG. 8, each of the chain drive motors **60*a* through 60*g* is coupled to ground on one side and coupled to a given respective one of contacts 150 through 156. Each of the other chain drive motors are coupled to contacts 150 through 156 in a similar manner as indicated by the phantom lines 157. As a result, all of the chain drive motors for a given range are coupled in parallel. All of the chain drive motors of a given range are selectively operable together through the operation of switch 128. For example, when switch 128 is in the position shown contacting contact 151, all of the chain drive motors in the second range will be energized and caused to run at a speed determined by switches 127***a* and 125 when latching relay 121 is energized.

Relay 121 has a first coil 160 and a second coil 161. The voltage across first coil 160 causes the latching relay contact 131 to close and a voltage across coil 161 causes relay contact 131 to open. The relay may be energized by the closing of control switches 122 and 123. Switch 123 has two ganged sections, section 123*a* being normally open and section 123*b* being normally closed. Switch 122 may be left open if the target range instructor or other operating personnel wishes to maintain all of the target stationary. If the targets are to move, switch 122 is closed so that when switch 123*a* is closed and 123*b* is simultaneously opened, the 28 volts at terminal 162 will be applied across first coil 160 causing contact 131 to close and to thus supply the AC voltage inputs at terminals 129 and 130 to power supply 120. This will cause the different output voltages to be provided across outputs 132 to 137 and the given one of those output voltages to be applied to each chain drive motor of a selected range selected by switch 128.

Each of the home positions switch contacts 45*a* for each firing lane are coupled in series with the second coil 161 and terminal 163 which is coupled to the 28 volt power source. When all of the targets of the selected range have returned to home position, each of the switches 45*a* will close and complete a voltage path from terminal 163 through switch section 123*b*, through each of the switches 45*a*, to the second coil 161 to deactivate relay contact 131. When this happens, AC power input to terminals 129 and 130 is turned off and power supply 120 will terminate the application of the energizing power voltages to the chain drive motors so that the chain drive motors will stop causing the moving targets to stop at their home positions.

Referring now to FIG. 9, FIG. 9 shows the control circuitry for selectively raising or lowering the target members 41 of each target assembly 30 which are included within the selected range. The control circuitry of FIG. 9 includes control switches 123*c*, 170, 171, 127*b* and 128*b*. The control circuit of FIG. 9 also includes a latching relay 172, and relay 173. Also shown in FIG. 9 is one set of trip switches 49, 50, and 51 which correspond to the trip switches along the second straight section of the traveling target assembly of FIG. 1. The phantom lines 75 indicate that each set of trip switches for both the first and second straight sections of each travel target assembly are arranged in a similar manner.

Latching relay 172 applies to the target drive means motor 60 a first polarity voltage for raising the target members and a second polarity voltage for lowering the target members. Latching relay 172 includes a first coil 180 and a second coil 181. When a voltage is applied across coil 180, relay 172 will provide the second polarity voltage.

Relay 172 includes contacts 182, 183, 184, 185, 186 and 187. Contacts 182 and 186 are coupled together and contacts 183 and 185 are coupled together. Also, diode 188 couples contact 186 to contact 185. Relay 172 also has contact arms 189, 190 and 191.

Switch 128*b* is the second section of switch 128*a* as shown in FIG. 8. It includes contacts 192 through 198 for selecting the first to the seventh ranges respectively. Coupled to each of the contacts 192 through 198 is a relay such as relay 173 shown coupled to contact 196. Relay 173 has three sets of contacts 200, 201 and 202. Contact 202 is coupled to each chain drive motor 60 which resides in the fifth range. Contact 201 is coupled to each normally closed section 111*a* of microswitch 111 (FIG. 2) of each target drive assembly associated with the fifth range and in a like manner, contact 200 is coupled to its normally closed contact switch 112 associated with each target member drive means of the fifth range. As a result, switch 128*b* selects each of the target member drive means for a given range simultaneously with the selection of the chain drive motors for a given range with the simultaneous operation of section 128*a* (FIG. 8).

When the target members of all travel target guides of a given range are to be raised, section 128*b* is positioned for the proper range, for example, range 5 shown in FIG. 9, and then switch 123*c* is closed. Switch 123*c* is the third section of switch 123 which includes sections 123*a* and 123*b* as shown in FIG. 8. When switch 123*c* is closed, a voltage is applied across first coil 180 which causes wipers 189, 190 and 191 to assume their position shown in FIG. 9. When switch 128*b* is in its position shown, contacts 200, 201, 202 will be closed. As a result, a current path is established from terminal 203, through arm 189, to contact 186, through contact 202, to motor 60, to switch 111*a*, to contact 201, to contact 184, to arm 191, to contact 185, to contact 183, through arm 190 to ground. Thus, the first polarity voltage is applied across motor 60 which will cause motor 60 to drive its drive shaft in a first angular direction for raising its target member. When the target member is fully raised, end 114 of arm 76 as shown in FIG. 2, will contact arm 113 of switch 111 which will open switch 111*a* to terminate the application of the first polarity voltage to motor 60 to stop motor 60. The motor is thus stopped after a predetermined time interval of one second has elapsed since the target was fully raised.

Because switch sections 123*c* of FIG. 9, and 123*a* and 123*b* of FIG. 8 all operate together, the chain drive motors will be caused to operate while the target is being raised. After the targets have been raised for a period of one second, simultaneously with the opening of switch 111*a* to stop motor 60, the selected chain engaging means will be energized to cause the target to travel down the selected first or second straight sections of the travel guides. The circuit for activating the chain engaging means is shown in FIG. 10.

FIG. 10 shows a switch 210 for selecting which of the first or second straight sections the targets will travel down. The circuit of FIG. 10 also includes first and second solenoids 211 and 212 respectively having latching contacts 213 and 214 respectively. The solenoids 211 and 212 also have shafts 215 and 216. Shaft 215 moves laterally to cause the chain engaging means associated with it to engage its chain when solenoid 211 is activated and in a like manner, shaft 216 moves laterally when solenoid 212 is activated. Switch 45*b* and switch 45*b*′ comprise the second normally closed contacts of switch 45 as shown in FIG. 1. Switch 111*b* and 111*b*′ comprise a normally open contacts of switch 111 as shown in FIG. 2. Each carriage base of each traveling target assembly includes the circuit of FIG. 8. It operates as follows.

The instructor or other operating personnnel sets switch 210 in accordance with the desired first or second straight section of travel for the moving targets. Switch 210 connects the 28 volt power source at terminal 220 to contact 221. After the target is raised for the period of one second, and end 114 of arm 76 (FIG. 2) contacts arm 113 of switch 111, switch section 111*b* will close causing solenoid 211 to be activated and to move shaft 215 laterally for causing its associated chain engaging means to engage its associated chain. At the same time, latching contact 213 is closed. When the target carriage base returns to home position, switch 45*b* will open to disengage solenoid 211 and to thus cause the chain engaging means to disengage the chain for stopping the target simultaneously as the drive motors are stopped by the first sections 45*a* of the home position switch 45 as shown in FIG. 1. Switch section 45*b* is preferably a momentarily open contact which temporarily opens the circuit to solenoid 211 but which will return to its normally closed position.

Referring again to FIG. 9, the target members may be lowered in response to anyone of three conditions. When any one of the three conditions is present, a voltage will be applied to the second coil 181 of latching relay 172 to cause the second polarity voltage to be applied to motor 60. When second coil 181 is energized, latching relay 172 will change state such that wiper 189 contacts contact 185. Thus, the second polarity voltage causes a current to flow through motor 60 in an opposite direction as that for raising the target so that the target will be lowered. Switch arm 191 when contacting 187 bypasses switch section 111*a* and introduces switch 112 into the circuit. Switch 112 is also shown in FIG. 2. When the target is fully lowered, end 114 of arm 76 (FIG. 2) will contact switch 112 causing the second polarity voltage to be terminated for stopping the motor.

The three conditions which cause the target to be lowered are manual operation by the instructor, the target being hit before it reaches the selected one of the trip switches, or the carriage base tripping the selected one of the trip switches before the target has been hit.

The target may be manually lowered by the closing of switch 170. This applies the 28 volts at terminal 222 to the second coil 181. At any time, the instructor or other operating personnel may manually close switch 170 for lowering the targets.

The second condition which causes the target members to be lowered is the hitting of the targets prior to reaching one of the selected trip switches. In this mode, the operator closes switch 171. Upon a marksman hitting the target, a receiver (not shown) provides a signal to relay 225 across coil 226 to close relay contact 227 for coupling the 28 volt power source at terminal 228 to the second coil. This will reverse latching relay 172 to cause motor 60 to lower the targets.

Lastly, the targets can be lowered when the carriage bases reach the selected limit switches without being hit by a marksman. For example, if switch section 127*b* is in the position shown, when a carriage base hits five meter limit switch 49 prior to a marksman hitting the target, switch 49 will be closed providing a closed path between the 28 volt power source at terminal 229 to the second coil 181 of latching relay 172. This will cause the target member to lower.

The embodiment of the invention just described is suitable for use in most any type of target practice range and in particular is most suitable for use in a target practice range wherein laser beams are used instead of bullets. A receiver (not shown) detects when a target has been hit and provides a hit signal to coil 226 of relay 225 for causing contacts 227 to close for lowering the target. Simultaneously, when a hit signal is provided, one shot circuit 230 provides a pulse to counter 231 for crediting the marksman hitting the target. One shot 230 may include a delay for crediting the marksman only once regardless of how many times he strikes the target.

Figure 11:
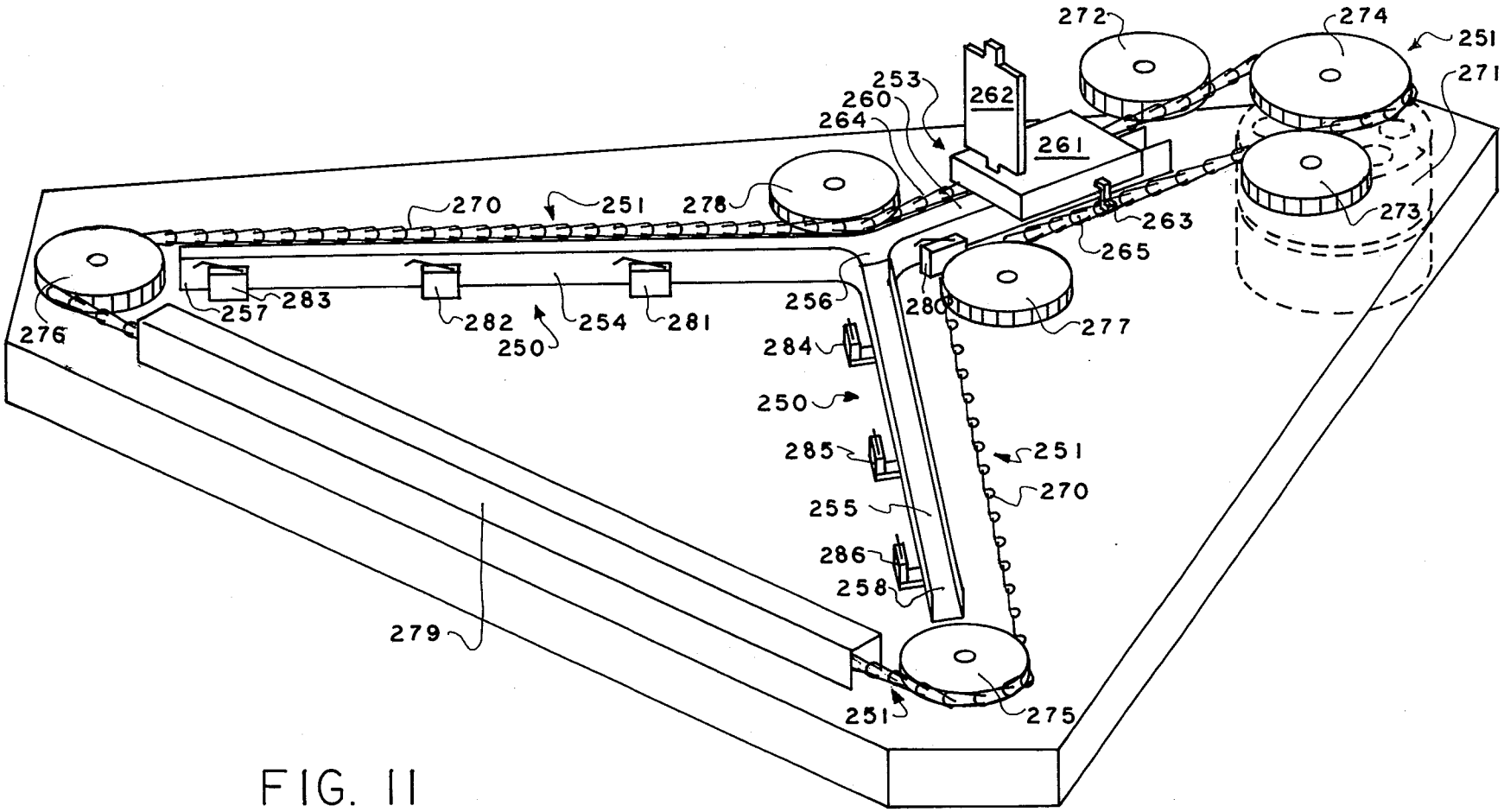
FIG. 11 is a perspective view showing another embodiment of a moving target assembly in accordance with the present invention.

FIG. 11 shows another embodiment of a moving target assembly which is configured in accordance with the present invention. The moving target assembly thereshown generally includes a target travel guide 250, chain drive means 251 and target means 253.

The target travel guide 250 includes a first straight section 254 and a second straight section 255. The first and second straight sections are joined at junction 256 which constitutes a home position. The first and second straight sections 254 and 255 respectively are substantially at right angles to one another and preferably arranged relative to a marksman position so that first straight section 254 extends to the left of the marksman position at a 45° angle and second section 255 extends to the right of the marksman position at a 45° angle. First straight section 254 has a free end 257 and second straight section 255 has a free end 258.

The target travel guide additionally includes a third section 260 connected to the common junction 256 of the first and second sides 254 and 255 respectively. The first section 254, second section 255, and third section 260 are joined together in such a way that target means 253 is free to travel along either the first or second section in a manner to be described subsequently.

Target means 253 may be identical to the target means 13 of FIG. 1 and as described in detail relative to FIGS. 2 through 7. For that reason, target means 253 will not be described in detail herein. Suffice it to say that target means 253 includes a carriage base 261 which is adapted for traveling within the travel guide 250, a target member 262, and first and second chain engaging means, one of which is shown at 263. As in the prior described embodiment, the chain engaging means is selectively operable for engaging either a first chain side 264 or a second chain side 265.

The chain drive means 251 includes a sprocket chain 270 which runs substantially parallel to the first straight section 254, the second straight section 255, and the third straight section 260. The first side 260 of the chain runs on one side of the third section and the second side 265 of chain 270 runs along the other side of the third section. Chain drive means 251 also includes a motor 271 and sprocket gears 272, 273, 274, 275, 276, 277 and 278. As can be seen from FIG. 11, the chain is a continuous chain and runs through a chain guide 279 which is disposed in between sprocket gears 275 and 276.

The assembly of FIG. 11 also includes a switch 280 at the home position. Switch 280 is arranged relative to the third section 260 so that its contacts are tripped as the carriage 261 of target means 253 passes by it. Switch 280 is identical to switch 45 of FIG. 1 and includes a contact for stopping motor 271 when carriage 261 returns to the home position and another contact for disengaging the chain engaging means.

Spaced along each of the first and second straight sections are a plurality of trip switches. First straight section 254 has a first set of trip switches 281, 282, and 283, and second straight section 255 has a second set of trip switches 284, 285 and 286. The trip switches of each set are equally spaced with trip switches 281 and 284 being preferably 5 meters from home position, trip switches 282 and 285 being preferably 7.5 meters from home position, and trip switches 283 and 286 being preferably 10 meters from home position.

Each of the trip switches includes a pair of contacts, one contact for causing the target number 262 to be lowered, and the other contact, for causing motor 271 to reverse direction. The pair of contacts in each trip switch are simultaneously actuated when the carriage 261 engages the contacts.

In operation, the target means 253 preferably includes the target drive mechanism shown in FIG. 2. As previously explained, after the target member 262 has been fully raised for a period of one second, a selected one of the chain engaging means will engage the chain 270 on its respective side. For example, if it is desired to have the target means 253 travel down the second straight section 255, the solenoid associated with chain engaging means 263 will be actuated in a manner previously describdd. Simultaneously, the motor 60 (In FIG. 2) which has raised target member 262 will be turned off.

Now that chain engaging means 263 has engaged with the second side 265 of chain 270, a motor 271 turns sprocket gear 174 in a clockwise direction to cause the chain 270 to run in a direction from home position to the second end 258 of second straight section 255. Preferably, the direction of motor 271 is so established at the time that chain engaging means 263 is selected by the operator.

Now, the target means 253 will be moved along the travel guide under the influence of chain 270. When the target means reaches sprocket gear 277 it will be pulled around junction 256 and into the second straight section 255. If the target is not hit before it reaches one of the selected trip switches 284, 285 or 286, upon reaching the selected trip switch, the target member 262 will be lowered by one actuated contact and the direction of motor drive of motor 271 will be reversed responsive to the other contact. At this time, the target means 253 will be returned back to home position. When it reaches home position it actuated switch 280 which will then cause motor 271 to stop and will also cause the chain engaging means 263 to be disengaged in a manner such as that previously described in relation to the target assembly of FIG. 1.

The control circuits of FIGS. 8, 9 and 10 may be utilized for controlling the moving target assembly of FIG. 11. The only additional control which is required is a reversing relay or the like coupled to motor 271 for causing it to turn sprocket gear 274 in either a clockwise or counter clockwise direction. Circuits for providing this additional control are well known.

While particular embodiments of the invention have been shown and described, modifications may be made and it is intended in the appended claims to cover all such modifications as may fall within the true spirit and scope of the invention.

What is claimed is:

1. A moving target assembly for use in a target practice range comprising:

a target travel quite having first and second straight sections, said first and second straight sections being joined and being substantially at right angles to one another and each including a free end, and a third section connected to the common junction of said first and second sections, said common junction constituting a home position;

target means including a carriage base adapted for traveling within said travel guide, a target member on said carriage base, and target member drive means within said carriage base for selectively raising and lowering said target member;

first and second chain engaging means mounted on said target means and being selectively operable;

chain drive means running substantially parallel to said first, second, and third sections, and being arranged for cooperative engagement with said first and second chain engaging means for driving said target means from said home position along said first straight section when said first chain engaging means is selectively operated, and for driving said target means from said home position along said second straight section when said second chain engaging means is selectively operated; and a plurality of trip switches spaced along said first and second straight sections, each said switch being capable of actuation by said target means and selectively operable, each said trip switch also being coupled to said target drive means for causing said target member to be lowered responsive to the actuation of a selectively operated one of said trip switches by said target means.

2. An assembly in accordance with claim 1 wherein said target drive means includes a motor for lowering said target member in response to a first polarity energizing voltage and for raising said target member in response to a second polarity energizing voltage, and wherein said carriage base includes first and second limit switches coupled to said first and second polarity energizing voltages respectively and to said motor, said first limit switch terminating said first polarity energizing voltage to said motor after said target member has been fully lowered, and said second limit switching terminating said second polarity energizing voltage to said motor after said target member has been fully raised.

3. An assembly in accordance with claim 2 wherein said second limit switch terminates said second energizing voltage to said motor after said target member has been fully raised for a predetermined time period.

4. An assembly in accordance with claim 3 wherein said second limit switch also includes a normally open contact coupled to said first and second chain engaging means for energizing the selected one of said chain engaging means after said target member has been fully raised for said predetermined time period.

5. An assembly in accordance with claim 1 wherein said plurality of trip switches comprise a first set of trip switches equally spaced along said first straight section and a second set of trip switches equally spaced along said second straight section, wherein said chain drive means includes a motor and wherein said assembly further comprises a power supply including a plurality of outputs, each said output providing a different output voltage, and selection means for selectively coupling said outputs to said chain drive motor for causing said motor to run at a plurality of speeds.

6. An assembly in accordance with claim 5 wherein each of said first and second sets of trip switches comprises first, second and third trip switches, and wherein said selecting means is selectively operable for causing said motor to transport said target means from said home position to each of said first, second and third trip switches in second or third predetermined time periods.

7. A moving target assembly for use in a target practice range comprising:

a target travel guide having a generally U-shaped cross section, first and second mirror image half sections having first and second straight sections respectively which are substantially at right angles to one another, a common side having a first and second end, said first end being connected to the common junction of said first and second section constituting a home position, and first and second return portions connecting the free ends of said first and second straight sections respectively to said second end of said common side;

first and second chain means running substantially parallel to the target travel guide half sections, said first chain means being associated with said first half section, and said second chain means being associated with said second half section;

drive means for driving said first and second chain means, said first chain means being driven in a direction from said home position to said free end of said first straight section and said second chain means being driven in a direction from said home position to said free end of said second straight section;

target means including a carriage base adapted for traveling within said travel quide, a target member on said carriage base, and target member drive means within said carriage base for selectively raising and lowering said target member;

first and second chain engaging means mounted on said carriage base, said first and second chain engaging means being selectively operable; and a plurality of trip switches spaced along said first and second straight sections of said travel guide, each said switch being capable of actuation by said target means and selectively operable, each said trip switch also being coupled to said target drive means to thereby cause said target member to be lowered responsive to the actuation of a selectively operated one of said trip switches by said target means; whereby when said first chain engaging means is selectively operated, said target means travels along said first half section, and when said second chain engaging means is selectively operated, said target means travels along said second half section.

8. An assembly in accordance with claim 7 wherein said target member drive means includes a motor, said motor being capable of raising said target member responsive to a first polarity energizing voltage and being capable of lowering said target member responsive to a second polarity energizing voltage, and wherein said assembly further includes target drive control means coupled to said motor and including a latching relay having a first coil and a second coil for applying said first polarity voltage to said target means drive motor for causing it to raise said target member when said first coil is energized, and wherein said trip switches are coupled to said second coil to thereby cause said second coil to be energized when said target means actuates the selected one of said trip switches and to thereby cause said second polarity energizing voltage to be applied to said target drive motor for lowering said target member.

9. An assembly in accordance with claim 8 wherein said carriage base includes first and second limit switches coupled to said target drive means and to said target drive motor, said first switch terminating the application of said target drive motor energizing voltages after said target member has been fully lowered and said second switch terminating the application of said target drive motor energizing voltages after said target member has been fully raised.

10. An assembly in accordance with claim 9 wherein said target drive control means additionally comprises a relay associated with said latching relay for selectively connecting said first limit switch to said drive motor in response to the actuation of said selected one of said trip switches.

11. An assembly in accordance with claim 9 wherein said second limit switch terminates the application of said target drive motor energizing voltages after said target member has been fully raised for a predetermined time period.

12. An assembly in accordance with claim 11 wherein said second limit switch also includes a normally open contact coupled to said chain engaging means for energizing the selected one of said chain engaging means after said target member has been fully raised for said predetermined time period.

13. An assembly in accordance with claim 12 wherein said first and second chain engaging means comprise first and second solenoid respectively.

14. An assembly in accordance with claim 7 wherein said plurality of trip switches comprise a first set of trip switches along said first straight section and a second set of trip switches along said second straight section, each of said trip switches of each set being equally spaced, and wherein said assembly further comprises a power supply including a plurality of outputs, each said output providing a different output voltage, and selection means for selectively coupling said outputs to said chain drive motor for causing said motor to run at a plurality of speeds.

15. An assembly in accordance with claim 14 wherein each of said first and second sets of trip switches comprises first, second and third trip switches, and wherein said selecting means is selectively operable for causing said chain drive motor to transport said target means from said home position to each of said first, second, and third trip switches in second or third predetermined time periods.

16. A target range of the type which includes a plurality of firing lanes wherein the lanes include an equal number of ranges, said target range comprising:

a moving target assembly for each range within each lane, each said moving target assembly including a target means including a carriage base, a travel guide for accepting said carriage base and guiding said target means from a home position, through a predetermined path, and back to said home position, switch means disposed along said travel guide, target member drive means within said carriage base for selectively raising and lowering said target members in response to said target means encountering said switch means, and a drive motor means for driving said target means along said travel guide, said travel guide including a generally U-shaped cross section and, first and second mirror image half sections having first and second straight sections respectively which are substantially at right angles to one another, a common side having a first and second end, said first end being connected to the common junction of said first and second section constituting said home position, and first and second return portions connecting the free ends of said first and second straight sections respectively to said second end of said common side, said moving target assembly additionally including first and second chain means running substantially parallel to the target travel guides of each said half section, said first chain means being associated with said first half section, and said second chain means being associated with said second half sections, said drive motor being operatively coupled to said first and second chain means for driving said first and second chain means, said first chain means being driven in a direction from said home position to said free end of said first straight section and said second chain means being driven in a direction from said home position to said free end of said second straight section, said target means further including first and second chain engaging means within said carriage base, said first and second chain engaging means being selectively operable so that when said first chain engaging means of each said moving target assembly is selectively operated, each said target means travels along its associated first half section, and when each said second chain engaging means is selectively operated, each said target means travels along its associated said second half section;

a power supply for providing energizing power for each said drive motor; and control means for selectively connecting said power supply to each said drive motor of a given range.

17. A target range in accordance with claim 16 wherein said switch means includes a plurality of trip switches spaced along each said first and second straight sections of said travel guides, each said switch being capable of actuation by said target means and selectively operable, each said trip switch also being coupled to its associated target drive motor to thereby cause each said target member to be lowered responsive to the actuation of a selectively operated one of said trip switches by said target means.

* * * * *

UNITED STATES PATENT OFFICE

CERTIFICATE OF CORRECTION

PATENT NO. : 4,076,247

DATED : February 28, 1978

INVENTOR(S) : Raymond W. H. Kim and Erwin E. Figge

It is certified that error appears in the above-identified patent and that said Letters Patent are hereby corrected as shown below:

Column 13, line 62 (Claim 1, line 3), change "quite" to --guide--.

Column 15, line 27 (Claim 7, line 27), change "quide" to --guide--.

Signed and Sealed this

*Twenty-sixth* Day of *June 1979*

[SEAL]

*Attest:*

RUTH C. MASON
*Attesting Officer*

DONALD W. BANNER
*Commissioner of Patents and Trademarks*